US009571911B2

(12) United States Patent
Poulsen et al.

(10) Patent No.: US 9,571,911 B2
(45) Date of Patent: Feb. 14, 2017

(54) MICROPHONE ASSEMBLY WITH A BEND AND CLAMP

(71) Applicant: DPA Microphones A/S, Allerød (DK)

(72) Inventors: Anders Poulsen, Holte (DK); Christian Poulsen, Frederiksberg (DK)

(73) Assignee: DPA Microphones A/S, Allerød (DK)

( * ) Notice: Subject to any disclaimer, the term of this patent is extended or adjusted under 35 U.S.C. 154(b) by 0 days.

(21) Appl. No.: 15/023,965

(22) PCT Filed: Sep. 24, 2014

(86) PCT No.: PCT/EP2014/070385
§ 371 (c)(1),
(2) Date: Mar. 22, 2016

(87) PCT Pub. No.: WO2015/044211
PCT Pub. Date: Apr. 2, 2015

(65) Prior Publication Data

US 2016/0241944 A1 Aug. 18, 2016

(30) Foreign Application Priority Data

Sep. 24, 2013 (EP) ..... 13185668

(51) Int. Cl.
*H04R 1/02* (2006.01)
*H04R 1/08* (2006.01)
*H04R 31/00* (2006.01)

(52) U.S. Cl.
CPC ..... *H04R 1/08* (2013.01); *H04R 31/006* (2013.01); *H04R 2410/03* (2013.01)

(58) Field of Classification Search
CPC ..... H04R 1/08; H04R 31/006
See application file for complete search history.

(56) References Cited

U.S. PATENT DOCUMENTS 4,893,344 A 1/1990 Trägardh et al.
6,178,251 B1 * 1/2001 Luchs ..... H04R 1/083 381/362

(Continued)

FOREIGN PATENT DOCUMENTS

AT 303145 11/1972
CN 201995107 U 9/2011

(Continued)

OTHER PUBLICATIONS

Extended European Search Report for EP 13 18 5668 dated Dec. 20, 2013.

(Continued)

*Primary Examiner* — Simon King
(74) *Attorney, Agent, or Firm* — Knobbe Martens Olson & Bear LLP

(57) ABSTRACT

A microphone assembly is disclosed, the microphone assembly comprising: a microphone for converting an acoustic signal to an electrical microphone signal; and a rigid tube with a first tube end and a second tube end. The microphone is attached at the first tube end. The rigid tube encloses at least a part of a first conductor for conducting the microphone signal. The rigid tube has a first tube part extending along a first axis, and the rigid tube has a first bend between the first tube end and the first tube part. A clamp member is mounted on the rigid tube, wherein the clamp member is configured for clamping the microphone assembly to a piece of clothing placed between a clamping section of the rigid tube and a clamping section of the clamp member.

16 Claims, 4 Drawing Sheets

(56) References Cited

U.S. PATENT DOCUMENTS

| | | | | |
|---|---|---|---|---|
| 6,934,461 | B1 | 8/2005 | Strub et al. | |
| 2006/0182301 | A1* | 8/2006 | Medveczky | H04R 1/08 381/362 |
| 2006/0285713 | A1 | 12/2006 | Lin | |
| 2008/0253599 | A1 | 10/2008 | Banks | |
| 2010/0083470 | A1* | 4/2010 | Murata | H04R 1/08 24/3.12 |
| 2010/0226512 | A1* | 9/2010 | Sykes | G09B 5/04 381/111 |
| 2012/0314131 | A1* | 12/2012 | Kamin-Lyndgaard | H04N 5/772 348/515 |
| 2014/0126740 | A1* | 5/2014 | Charles | H04R 1/1066 381/74 |

FOREIGN PATENT DOCUMENTS

| | | | |
|---|---|---|---|
| DE | 2052442 | | 12/1971 |
| DE | 3911068 | A1 | 10/1989 |
| DE | 41 13 101 | A1 | 10/1992 |
| DE | 41 26 724 | A1 | 2/1993 |
| DE | 10 2005 055 762 | A1 | 5/2007 |
| DE | 10 2008 005 107 | A1 | 7/2009 |
| DE | 10 2008 005 109 | A1 | 7/2009 |
| JP | 2001-268678 | A | 9/2001 |
| JP | 2004-254262 | A | 9/2004 |
| WO | WO 96/31994 | A1 | 10/1996 |

OTHER PUBLICATIONS

International Search Report for PCT/EP2014/070385 dated Nov. 25, 2014.

* cited by examiner

MICROPHONE ASSEMBLY WITH A BEND AND CLAMP

CROSS REFERENCE TO RELATED APPLICATIONS

This application is a U.S. National Phase Application of PCT International Application Number PCT/EP2014/070385, filed on Sep. 24, 2014, designating the United States of America and published in the English language, which is an International Application of and claims the benefit of priority to European Patent Application No. 13185668.4, filed on Sep. 24, 2013. The disclosures of the above-referenced applications are hereby expressly incorporated by reference in their entireties.

The present invention relates to a microphone, such as a lavalier microphone, or clip microphone, in particular to a microphone assembly comprising a rigid tube with a bend for guiding a conductor and positioning the microphone.

BACKGROUND

Actors, TV hosts, performers or users alike, want their voice to be recorded or amplified in high sound quality while seeking a microphone which is as invisible as possible to not take away the focus of the viewer.

In order to attain and maintain a high quality sound recording, the microphone needs to maintain a very precise location in respect to the mouth of the user.

A lavalier microphone is a small microphone that is mounted to the user, e.g. to a shirt, in order to allow hands-free operation. A lavalier microphone is most commonly provided with a small clip for attaching the microphone to collars, ties, or other clothing. The cord may be hidden by clothes and wired to an auxiliary device such as a radio frequency transmitter kept in a pocket or clipped to a belt, or wired directly to a mixer or a recording device.

However, several problems arise in known assemblies of lavalier microphones. First of all, the clip may be bulky, lack precise attachment, and/or may damage the clothes to which it attaches. Secondly at least part of the conducting cable extending from the microphone may not be properly hidden. Lastly the microphone, cable and clip assembly may be subject to noise e.g. from the cable scratching against the clothes near the microphone, or the clothes scratching directly on the microphone.

DE 10 2008 005 109 A1 discloses a clip-on microphone wherein the microphone cable is provided in a clamp and having a microphone cable running within an arm of the clamp on a rear side and behind a piece of clothing of a person. However, the clip-on microphone in accordance with DE 10 2008 005 109 provides a clamp visible for an observer. Furthermore, a microphone in accordance with DE 10 2008 005 109 is prone to noise due to its position, and a wire provided in a clamp may be subject to failure.

SUMMARY

Accordingly and despite the known solutions there is still a need for a lavalier microphone which, in a simple and effective way, hides cables and other bulky parts, while attaining a high quality sound and reducing possible causes of noise.

Accordingly, a microphone assembly is provided, the microphone assembly comprising a microphone for converting an acoustic signal to an electrical microphone signal; and a rigid tube with a first tube end and a second tube end, wherein the microphone is attached at the first tube end, the rigid tube enclosing at least a part of a first conductor for conducting the microphone signal. The rigid tube has a first tube part extending along a first axis, and the rigid tube has a first bend, e.g. between the first tube end and the first tube part.

Also disclosed is a microphone assembly comprising a microphone for converting an acoustic signal to an electrical microphone signal, a rigid tube with a first tube end and a second tube end, wherein the microphone is attached at the first tube end, the rigid tube enclosing at least a part of a first conductor for conducting the microphone signal, and a clamp member mounted on the rigid tube, wherein the clamp member is configured for clamping the microphone assembly to a piece of clothing placed between a clamping section of the rigid tube and a clamping section of the clamp member, wherein the rigid tube has a first tube part extending along a first axis, and wherein the rigid tube has a first bend between the first tube end and the first tube part.

It is an advantage of the present disclosure that means are provided for positioning the microphone distant from sources of scratching noise. Further, it is an important advantage of the microphone assembly that means for hiding and guiding the conducting parts of the microphone assembly are provided.

Further, the microphone assembly provides for easy and convenient positioning of the microphone assembly, such that the microphone assembly may be fast and easily attached, to e.g. a guest in a TV-studio, in a manner reducing potential sources of noise.

Possible noise sources may e.g. be clothes scratching against the microphone, or cables scratching against clothes in proximity to the microphone.

BRIEF DESCRIPTION OF THE DRAWINGS

The above and other features and advantages of the present invention will become readily apparent to those skilled in the art by the following detailed description of exemplary embodiments thereof with reference to the attached drawings, in which.

DETAILED DESCRIPTION

Figure 1:
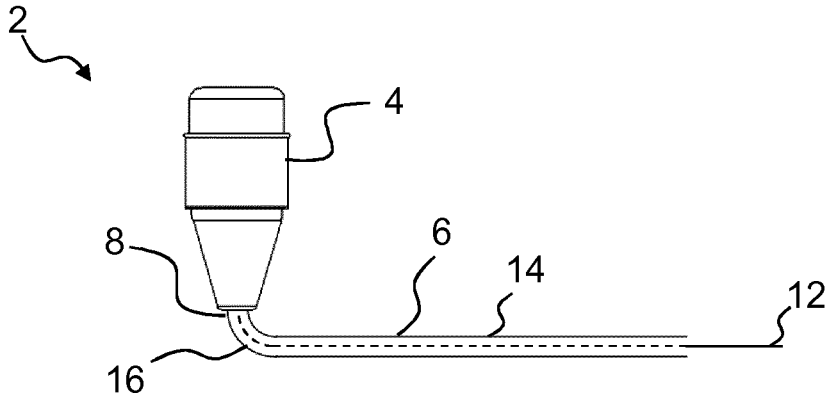
FIG. 1 schematically illustrates an exemplary microphone assembly with a first bend, FIG. 2 schematically illustrates an exemplary microphone assembly with marked axes, FIG. 3 schematically illustrates an exemplary microphone assembly with a second bend, FIG. 4 schematically illustrates an exemplary microphone assembly with a clamp member, FIG. 5 schematically illustrates an exemplary microphone assembly with a second bend and a clamp member, FIG. 6 schematically illustrates an exemplary microphone assembly with a second bend and a clamp member, FIG. 7 schematically illustrates a cross section of an exemplary microphone assembly, and FIG. 8 schematically illustrates an exemplary microphone assembly.

The figures are schematic and simplified for clarity, and they merely show details which are essential to the understanding of the invention, while other details have been left out. Throughout, the same reference numerals are used for identical or corresponding parts. It is to be noted that the wording "first" and "second" are used for separating elements of similar function. Thus, a "second" element does not necessarily require the presence of a "first" element.

The rigid tube is rigid, or stiff, in the sense resembling a typical metal where the physical form of the rigid tube is maintained if the microphone assembly is used as preferred, i.e. during preferred use plastic deformation will be none or at least limited, and yield strength and proportionality limit are largely equal.

The rigid tube may be made of a material having an elastic modulus larger than a first threshold value, such as 50 GPa. The rigid tube may be made of a material having an elastic modulus larger than a first threshold value of 100 GPa. The rigid tube may be made of stainless steel.

The rigid tube may be made of an electrically conductive material, such as a metal or an alloy comprising one or more metals. The rigid tube may be made of a composite material, e.g. comprising one or more polymers. The composite material may comprise a metal. The rigid tube may form a channel accommodating at least a part of the first conductor. An insulator may insulate the first conductor from the rigid tube.

The rigid tube may have a length larger than 1 cm and/or less than 10 cm. The length of the rigid tube may be between 1 cm and 8 cm, such as between 2 cm and 6 cm, such as between 3 cm and 5 cm. The first tube part may have a length in the range from 1 cm to 5 cm, such as from 2 to 3 cm. The length of the first tube part may be sufficiently long to allow for a first clamping section on the first tube part. On the other hand the length of the first tube part may be limited in order to provide a microphone assembly that is hard to see when attached e.g. on a shirt.

The tube may have a diameter of less than 5 mm, such as less than 3 mm, such as less than 2 mm, e.g. 1.2 mm. The tube diameter may be larger than 0.5 mm to provide a sufficiently rigid tube.

Generally, the microphone assembly or at least the visible parts should be as small as possible in order to be as invisible as possible. On the other hand, the microphone assembly should be large enough to be easy to handle and allowing proper attachment to the piece of clothing. The microphone assembly of the present invention has small visible parts and enables hiding of a clamp member.

The microphone may be a directional or an omni-directional microphone. The microphone may be orientated on the microphone assembly having a direction towards the mouth of the user, especially if a directional microphone is used. The microphone may be orientated on the microphone assembly having a universal direction to account for different clothing and positioning of the microphone assembly The microphone assembly may comprise a second conductor connected to the microphone, e.g. for providing a ground electrode. The rigid tube may be a conductive tube forming at least a part of the second conductor. In exemplary microphone assemblies, the rigid tube encloses at least a part of the second conductor.

The second tube end may be attached to a cable, and thus the cable may enclose a part of the first conductor. In exemplary microphone assemblies, the rigid tube may comprise a connector with first and second terminals attached to the second tube end for connecting the microphone assembly to an electrical cable or external device comprising a corresponding connector. The first terminal may be connected to the first conductor. The second terminal may be connected to the second conductor.

The rigid tube comprises one or more bends or bend sections, such as a first bend and/or a second bend.

The first bend may position the microphone away from the clothing, thus reducing noise from various sources. The first bend may bend the rigid tube in an angle in the range from 30 degrees to 270 degrees. In exemplary microphone assemblies, the first bend bends the rigid tube in an angle in the range from 45 degrees to 135 degrees, e.g. from 80 degrees to 100 degrees. The first bend may be arc-shaped. The first bend may be a 90 degrees bend forming an L-shaped first bend, or a 180 degrees bend forming a U-shaped first bend. The first bend may have a first radius of curvature less than 10 mm, such as in the range from 1 to 5 mm, e.g. 2 mm.

A first tube end axis extends in a longitudinal direction of a section of the rigid tube at the first tube end. A first angle between the first tube end axis and the first axis may be larger than 30 degrees, such as in a range from 30 degrees to 150 degrees, such as in a range from 60 degrees to 120 degrees, such as in a range from 80 degrees to 100 degrees, such as 90 degrees or approximately 90 degrees.

The rigid tube may comprise a second bend. The second bend may be between the first tube part and the second tube end. The second bend may bend the rigid tube in an angle in the range from 30 degrees to 270 degrees. In exemplary microphone assemblies, the second bend bends the rigid tube in an angle in the range from 45 degrees to 135 degrees, e.g. from 80 degrees to 100 degrees. In exemplary microphone assemblies, the second bend bends the rigid tube in an angle in the range from 135 degrees to 270 degrees, e.g. from 170 degrees to 240 degrees. The second bend may be arc-shaped. The second bend may comprise one or more straight parts, e.g. a first straight part between two sharp L-shaped bends thus forming a 180 degrees bend. The second bend may be a 90 degrees bend forming an L-shaped second bend or a 180 degrees bend forming a U-shaped second bend. The second bend may have a second radius of curvature less than 10 mm, e.g. in the range from 2 mm to 6 mm, such as 4 mm.

The second bend may direct conducting parts of the microphone assembly around an edge of a piece of clothing, such as to hide a cable, a cable connector and other bulky parts behind the piece of clothing. For example, the microphone assembly may be attached to the front opening of a buttoned shirt, the second bend will guide the conducting parts to the rear side of the clothing, i.e. the side of the clothing opposite the side presenting the microphone.

A second tube end axis extends in a longitudinal direction of a section of the rigid tube at the second tube end. A second angle between the second tube end axis and the first axis may be larger than 30 degrees, such as in a range from 30 degrees to 150 degrees, such as in a range from 60 degrees to 120 degrees, such as in a range from 80 degrees to 100 degrees, such as 90 degrees or approximately 90 degrees. The second tube end axis and the first axis may be parallel for example when the rigid tube comprises a second bend, e.g. a U-shaped second bend. The second angle between the second tube end axis and the first axis may be less than 30 degrees.

The first tube part may be a straight tube part, e.g. having a length in the range from 5 mm to about 50 mm or longer.

The rigid tube part may comprise a second tube part. The second tube part may be between the second bend and the second tube end. The second tube part may be a straight tube part, e.g. having a length in the range from 5 mm to about 50 mm or longer. The second tube part may be arched. The rigid tube part may comprise a third tube part. The third tube part may be between the first bend and the first tube end. The third tube part may be a straight tube part, e.g. having a length in the range from 5 mm to about 50 mm or longer.

The rigid tube may comprise one or more clamping sections. A clamping section of the rigid tube facilitates clamping of the microphone assembly to a piece of clothing placed between two clamping sections, e.g. between a first clamping section and a second clamping section of the rigid tube and/or between a clamping section of the rigid tube and a clamping section of a clamp member. The first tube part may comprise a first clamping section on the first tube part and/or a second clamping section on the second tube part.

A clamping section of the rigid tube, e.g. the first clamping section and/or the second clamping section, may be covered or at least partly covered with a material, e.g. silicone or other rubber material, for providing increased friction compared to the rigid tube material.

The microphone assembly may comprise a clamp member mounted on the rigid tube. The clamp member may be configured for clamping the microphone assembly to a piece of clothing placed between a clamping section of the rigid tube and a clamping section of the clamp member. The clamp member may comprise a resilient member, such as a leaf spring. The clamp member may comprise one or more support elements, e.g. a first support element and/or a second support element. A part of the clamp member may be covered with a material, e.g. silicone or other rubber material, for providing increased friction compared to the clamp member material. The first tube part may comprise a first clamping section of the rigid tube. The second tube part may comprise a second clamping section of the rigid tube.

The clamping section of the clamp member is at least the part of the clamp member that provides a clamping pressure towards a clamping section of the rigid tube. Thus, a clamping section of the rigid tube is located opposite the clamping section of the clamp member.

The clamp member may assist in affixing the microphone assembly to a piece of clothing. The piece of clothing may be placed between the clamping sections, and tube parts or the clamp member and the rigid tube may in combination provide a pressure on the piece of clothing. Thereby friction between the piece of clothing and the rigid tube and/or the clamp member may affix the microphone assembly to the piece of clothing. Providing the clamp member with a resilient member, such as a leaf spring, may provide an ability to affix the microphone assembly to clothing of different thicknesses, e.g. a thin shirt or a thick jacket.

The clamp member may be attached to the rigid tube at an attachment point. The attachment point may be on the first tube part or on the second tube part. The attachment point may be on the second bend. The clamp member may be attached to the rigid tube at a first attachment point and a second attachment point.

A distance from the second tube end to a plane perpendicular to the rigid tube in the clamping section may be less than 5 mm in order to reduce undesired pulling forces from a cable attached to the microphone assembly.

Small accidental jerks of a cable connected to the second tube end of the microphone assembly may produce a pulling force on the microphone assembly at the second tube end. By limiting the distance from the clamping section, the pulling force provides a reduced torque, or at least the torque is limited leading to a more stable affixing of the microphone assembly.

FIG. 1 schematically illustrates at least a part of an exemplary microphone assembly 2. The microphone assembly 2 comprises a microphone 4 and a rigid tube 6 having a diameter of about 1.2 mm. The rigid tube 6 has a first tube end 8 and a second tube end (not shown), and the rigid tube 6 at least partly encloses a first conductor 12 connected to the microphone 4. The microphone 4 is attached at the first tube end 8, and the first conductor 12 is configured for conducting a microphone signal from the microphone 4. The microphone assembly comprises a first conductor 12 at least partly enclosed in the rigid tube 6. The rigid tube comprises a first tube part 14, and a first bend 16 between the first tube part 14 and the first tube end 8. The first bend facilitates attachment of the microphone assembly to clothes such that the microphone is at a distance from the clothes surface, thus reducing undesired noise scratching noise. A connector (not shown) having first and second terminals may connect an electrical cable to the second tube end for connecting the microphone assembly to an auxiliary device (not shown).

Figure 2:
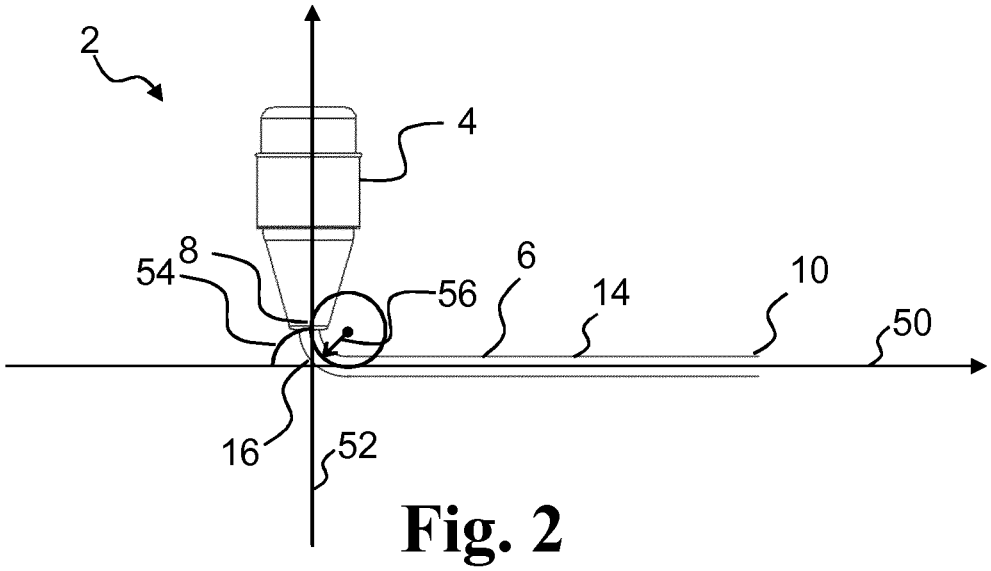

FIG. 2 schematically illustrates the exemplary microphone assembly 2 with a first axis 50 and a first tube end axis 52 depicted. The first axis 50 extends along a longitudinal center axis of the first tube part 14 of the rigid tube 6, thus, the first tube part 14 defines the first axis 50. The first tube end axis 52 extends along a longitudinal center axis of the first tube end 8, i.e. along an axis extending in a longitudinal direction of the rigid tube 6 at the first tube end 8.

The first axis 50 and the first tube end axis 52, span a first angle 54. Accordingly, the first angle 54 is the angle of the first bend 16. The first angle 54 may be in the range from 30 to 180 degrees, wherein 180 degrees corresponds to the first axis 50 and the first tube end axis 52 being parallel with a U-shaped first bend. The first angle 54 may be any angle larger than 30 degrees, such as larger than 50 degrees, such as larger than 70 degrees such as 90 degrees corresponding to an L-shaped first bend. In the depicted exemplary microphone assembly 2 as illustrated in FIGS. 1 and 2, the first angle 54 is 90 degrees.

The first bend 16 may be arc shaped, with a first radius of curvature 56 along a longitudinal center axis of the rigid tube 6. The first radius of curvature is less than 10 mm, e.g. as illustrated about 2 mm. The first bend 16 may effectively be L-shaped or another shape connecting the first tube end 8 with the first tube part 14 of the rigid tube 6.

Figure 3:
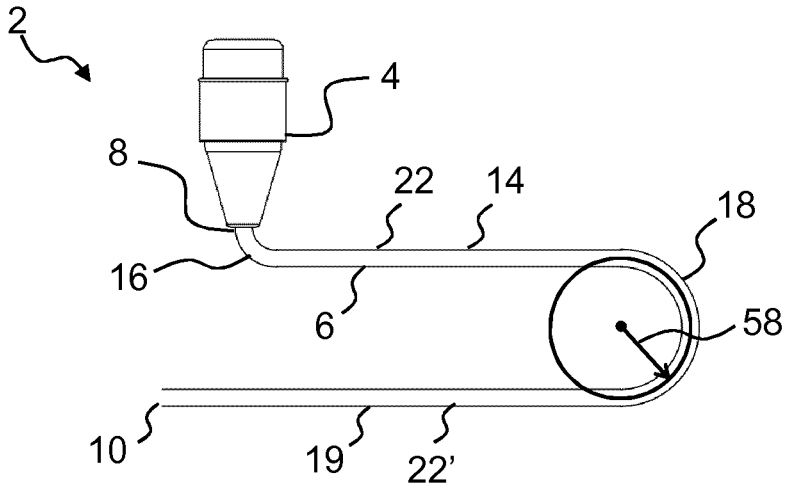

FIG. 3 schematically illustrates an exemplary microphone assembly 2 comprising a microphone 4, and a rigid tube 6, wherein the rigid tube has a first bend 16 and a second bend 18. The second bend 18 is arranged between the first tube part 14 and the second tube end 10. The second bend 18 is U-shaped, with a second radius of curvature 58 along a longitudinal center axis of the rigid tube 6. The second radius of curvature is less than 10 mm, e.g. as illustrated about 4 mm.

The second bend 18 provides guiding of the first conductor 12 around an edge of a piece of clothing (not shown). Hence, wiring is guided behind clothes and thus cables, connecting the microphone assembly 2 with e.g. an auxiliary device (not shown), are hidden. The rigid tube 6, as depicted in FIG. 3, comprises a second tube part 19 between the second bend 18 and the second tube end 10. The second bend 18 and the second tube part 19 may be designed such that a piece of clothing can be squeezed between opposing parts of the rigid tube 6, i.e. the first tube part 14 comprises a first clamping section 22 and the second tube part 19 comprises a second clamping section 22', to facilitate attachment of the microphone assembly to the piece of clothing.

If the microphone assembly 2 is to be mounted on a piece of clothing comprising an overlap, such as a buttoned shirt, the first tube part 14 can be hidden behind an outer most part of the overlap. The microphone assembly 2 can then be attached to an inner part of the overlap placed between the first tube part 14 and the second tube part 19. Hereby, the part of the microphone assembly extending in front of the shirt is minimized, possibly only the microphone 4.

Figure 4:
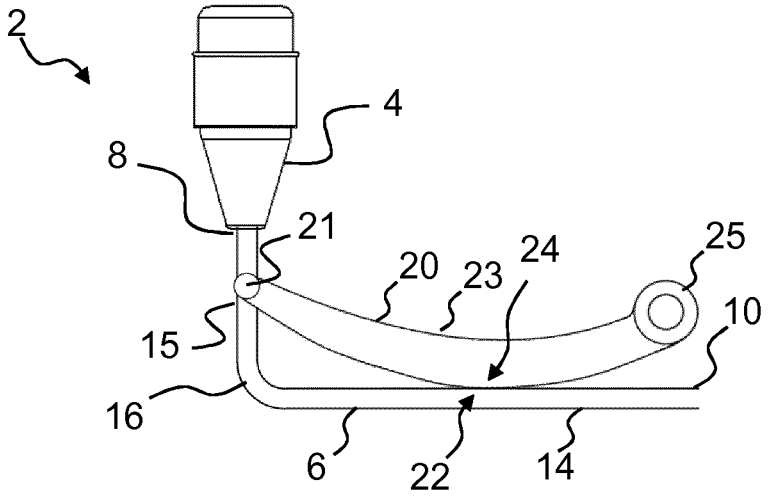

FIG. 4 schematically illustrates an exemplary microphone assembly 2 comprising a microphone 4, a rigid tube 6, and a clamp member 20. The clamp member 20 is configured to clamp a piece of clothing between a clamping section 24 of the clamp member 20 and a clamping section of the rigid tube 6, thus facilitating attachment of the microphone assembly to the piece of clothing. The clamping section of the rigid tube 6 is in FIG. 4 arranged as a first clamping section 22 in the first tube part 14. The clamp member may comprise a resilient member 23 such as a leaf spring, thereby providing a pressure, applied between the clamping sections 22, 24, that is suitable for a wide range of clothes thicknesses. The clamp member is attached to the rigid tube at an attachment point 21 on a third tube part 15 between the first tube end 8 and the first bend 16. The clamp member 20 has a rounded end 25 to facilitate attachment and detachment of the microphone assembly, e.g. such that a piece of clothing positioned between the clamping sections 22, 24 can be removed without damaging the clothes. The clamp member 20 is, in the exemplary microphone assembly 2 of FIG. 4, attached to the rigid tube 6 at an attachment point 21 between the first tube end 8 and the first bend 16.

The clamping of a piece of clothing relies on obtaining a frictional force between any of the clamping sections 22, 24 and the piece of clothing, wherein the frictional force is of a sufficient magnitude to maintain the microphone assembly 2 in the desired position. In order to increase the frictional force, the clamping section 22 of the rigid tube 6 and/or the clamping section 24 of the clamp member 20 may be at least partly covered by a material, e.g. silicone or other rubber material, increasing the friction comparing to the material of the rigid tube 6 and the clamp member 20 respectively.

Figure 5:
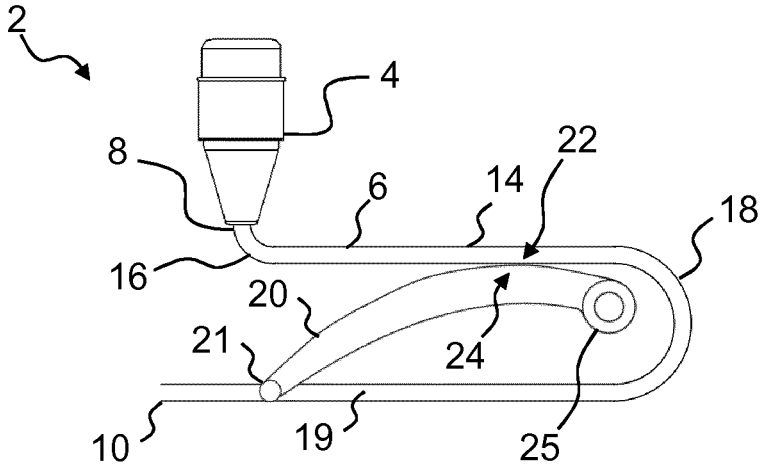

FIG. 5 schematically illustrates an exemplary microphone assembly 2 comprising a microphone 4, a rigid tube 6, and a clamp member 20 attached to the rigid tube. The rigid tube 6 comprises a a first tube part 14 between a first bend 16 and a second bend 18. Further, the rigid tube 6 comprises a second tube part 19 between the second bend 18 and the second tube end 10. The clamp member 20 is connected or attached to the rigid tube 6 at an attachment point 21 on the second tube part 19 proximal to the second tube end 10. The first clamping section 22 of the rigid tube 6 is on a side of the first tube part 14 facing away from the microphone. When a piece of clothing is positioned between the clamping sections 22, 24, the exemplary microphone assembly 2 has the clamp member 20 and the microphone 4 positioned on opposite sides of the piece of clothing. Thereby the clamp member is hidden behind the piece of clothing.

If the microphone assembly 2 is to be mounted on a piece of clothing comprising an overlap, such as a buttoned shirt, the first tube part 14 can be hidden behind an outer most part of the overlap. The microphone assembly 2 can then be attached to an inner part of the overlap placed between clamping sections 22, 24. Hereby the part extending in front of the shirt is minimized, and possibly only the microphone 4 is visible.

Figure 6:
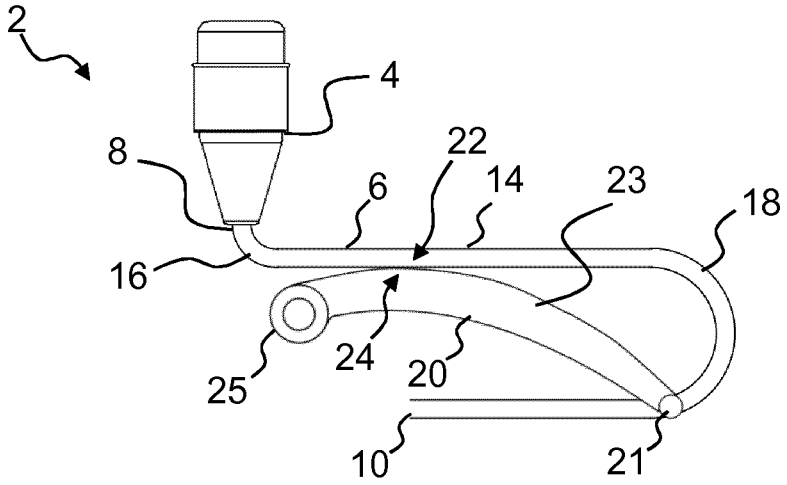

FIG. 6 schematically illustrates an exemplary microphone assembly 2 comprising a microphone 4, a rigid tube 6, and a clamp member 20 attached to the rigid tube. The rigid tube 6 comprises a first tube part 14 between a first bend 16 and a second bend 18. Further, the rigid tube 6 comprises a second tube part 19 between the second bend 18 and the second tube end 10. The clamp member 20 is connected or attached to the rigid tube 6 proximal to the second bend 18. The second tube end 10 is within a certain distance of a plane perpendicular to the clamping section 22 of the rigid tube 6. A cable may be connected to the second tube end 10, and hence this cable may introduce a pulling force. By limiting the distance between the second tube end 10 and the plane perpendicular to the clamping section 22 of the rigid tube 6, any torque resulting from the pulling force is limited and the pulling force is less prone to cause a rotation or displacement of the microphone assembly 2. The distance between the second tube end 10 and the plane perpendicular to the clamping section 22 of the rigid tube 6 may be less than 10 mm, such as less than 5 mm, such as less than 3 mm, such as less than 2 mm.

Figure 7:
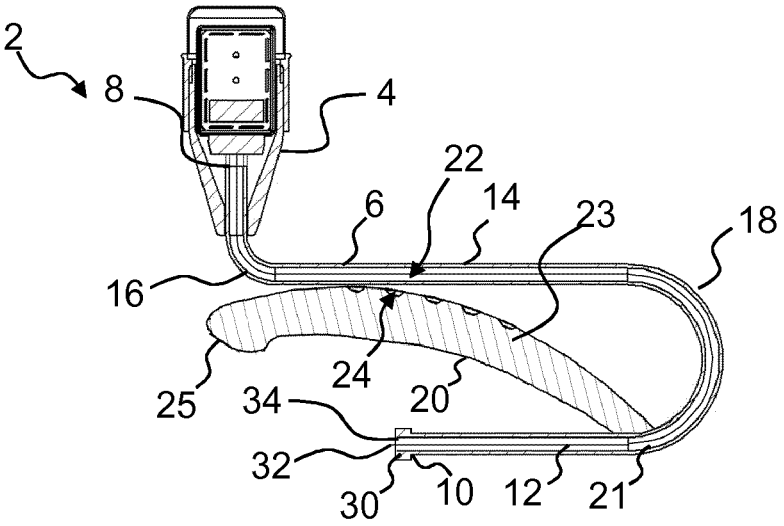

FIG. 7 schematically illustrates a cross section of an exemplary microphone assembly 2. It is seen that attachment of the microphone 4 on the first tube end 8 may involve a part of the rigid tube 6 to extend into a housing of the microphone 4. The microphone 4 is adapted to convert an acoustic signal to an electrical microphone signal. The microphone signal is fed through the first conductor 12 which extends from the microphone 4 and through a channel in the rigid tube 6. The microphone assembly 2 comprises a connector 30 at the second tube end 10. The connector 30 comprises a first terminal 32 and a second terminal 34. In FIG. 7 the connector 30 is depicted as a coax connector, wherein the first terminal 32 is connected to the first conductor 12, and the second terminal 34 is connected to the electrically conductive rigid tube 6 effectively functioning as a second conductor (e.g. ground). In general, other connectors may be contemplated. The rigid tube 6 is made from a conducting material such as a metal or an alloy, such as stainless steel, or composite material. Alternatively a second conductor (not shown) may extend from the microphone 4 and through the rigid tube 6, and connect to the second terminal 34. In general, the rigid tube 6 may be covered by an insulator.

Figure 8:
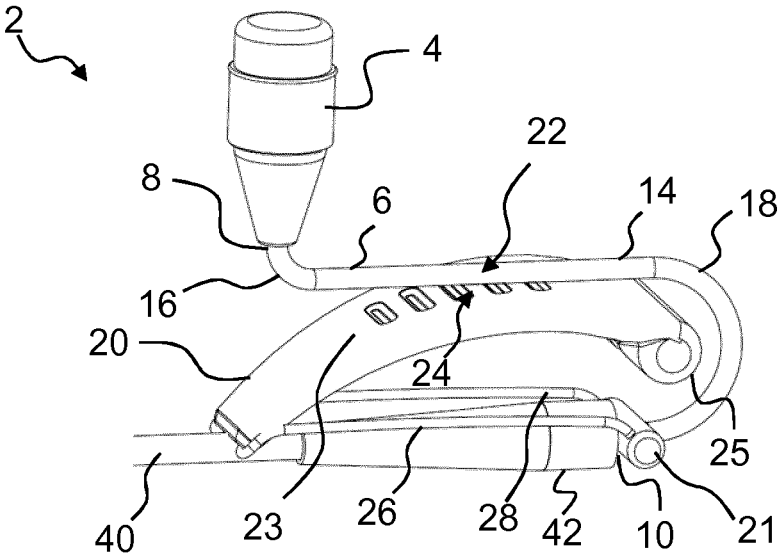

FIG. 8 schematically illustrates an exemplary microphone assembly 2 connected to a cable 40 with a cable connector 42. The microphone assembly 2 comprises a microphone 4, a rigid tube 6, and a clamp member 20, wherein the rigid tube 6 comprises a straight first tube part 14 between a first bend 16 and a second bend 18. The clamp member 20 comprises a resilient member 23, a first support element 26 and a second support element 28. The first and second support elements are attached at a first end thereof to the rigid tube at the second tube end 10 and are attached at a second end to the resilient member 23. The first 26 and second 28 support elements attaches the clamp member 20 to the second tube end 10 of the rigid tube 6.

LIST OF REFERENCES

2 microphone assembly
4 microphone
6 rigid tube
8 first tube end
10 second tube end
12 first conductor
14 first tube part
15 third tube part
16 first bend
18 second bend
19 second tube part
20 clamp member
21 attachment point, first attachment point
22 first clamping section
22' second clamping section

23 resilient member
24 clamping section of clamp member
25 rounded end of clamp member
26 first support element
28 second support element
30 connector
32 first terminal
34 second terminal
40 cable
42 cable connector
50 first axis
52 second axis
54 first angle

The invention claimed is:

1. A microphone assembly comprising:

a microphone for converting an acoustic signal to an electrical microphone signal, a rigid tube with a first tube end and a second tube end, wherein the microphone is attached at the first tube end, the rigid tube enclosing at least a part of a first conductor for conducting the microphone signal, and a clamp member mounted on the rigid tube, wherein the clamp member is configured for clamping the microphone assembly to a piece of clothing placed between a clamping section of the rigid tube and a clamping section of the clamp member, wherein the rigid tube has a first tube part extending along a first axis, and wherein the rigid tube has a first bend between the first tube end and the first tube part.

2. The microphone assembly according to claim 1, wherein a first angle between a first tube end axis and the first axis is larger than 30 degrees.

3. The microphone assembly according to claim 1, wherein the first bend is arc-shaped forming a first angle between a first tube end axis and the first axis in the range from 80 degrees to 100 degrees.

4. The microphone assembly according to claim 1, wherein the rigid tube has a second bend between the first tube part and the second tube end.

5. The microphone assembly according to claim 4, wherein the second bend is U-shaped.

6. The microphone assembly according to claim 1, wherein the clamp member comprises a resilient member.

7. The microphone assembly according to claim 6, wherein the resilient member is a leaf spring.

8. The microphone assembly according to claim 1, wherein the clamp member comprises one or more support elements.

9. The microphone assembly according to claim 1, wherein a distance from the second tube end to a plane perpendicular to the rigid tube in the clamping section is less than 5 mm.

10. The microphone assembly according to claim 1, wherein at least the clamping section of the rigid tube is covered with a material for providing increased friction compared to the rigid tube material.

11. The microphone assembly according to claim 1, wherein at least a part of the clamp member is covered with a material that provides increased friction compared to the clamp member material.

12. The microphone assembly according to claim 1, wherein the rigid tube comprises a connector with first and second terminals attached to the second tube end.

13. The microphone assembly according to claim 1, wherein the rigid tube forms a second conductor.

14. The microphone assembly according to claim 1, wherein the rigid tube has a length that is larger than 1 cm.

15. The microphone assembly according to claim 1, wherein the rigid tube has a length that is less than 10 cm.

16. The microphone assembly according to claim 1, wherein the rigid tube has a diameter that is less than 3 mm and larger than 0.5 mm.

* * * * *